United States Patent [19]

Potter

[11] 4,245,395

[45] Jan. 20, 1981

[54] FLUIDIZED BED DRYING

[75] Inventor: Owen E. Potter, Camberwell, Australia

[73] Assignee: Monash University, Victoria, Austria

[21] Appl. No.: 974,246

[22] Filed: Dec. 29, 1978

[30] Foreign Application Priority Data

Oct. 2, 1974 [AU] Australia ..... PD3344

[51] Int. Cl.[3] ..... F26B 3/08; F26B 3/10

[52] U.S. Cl. ..... 34/10; 34/32; 34/36; 34/37; 34/57 R

[58] Field of Search ..... 34/10, 32, 36, 37, 57 R, 34/57 A

[56] References Cited

U.S. PATENT DOCUMENTS

| | | | |
|---|---|---|---|
| 2,629,938 | 3/1953 | Montgomery | 34/10 |
| 3,654,705 | 4/1972 | Smith et al. | 34/10 |
| 3,751,214 | 8/1973 | Wenzel et al. | 34/10 |
| 3,800,427 | 4/1974 | Kemmetmueller | 34/10 |
| 4,043,049 | 8/1977 | Hedstrom | 34/10 |

*Primary Examiner*—John J. Camby

*Attorney, Agent, or Firm*—Larson, Taylor and Hinds

[57] ABSTRACT

The invention resides in one embodiment in a multiple effect method of and apparatus for drying a solid material containing a vaporizable material which comprises establishing at least first and second fluidized beds containing the solid material in which in at least the first fluidized bed the fluidizing medium is the vaporizable material in vapor form and in which the fluidized beds are heated indirectly, such that vaporizable material is removed from the solid material, the vaporizable material removed from the solid material in the first fluidized bed being used to provide the indirect heating of the second fluidized bed.

The invention resides in another aspect in a method of drying a solid material containing a vaporizable material which comprises establishing a fluidized bed containing the solid material in which the fluidizing medium is the vaporizable material in vapor form and in which the fluidized bed is heated indirectly by vaporizable material in the form of a saturated vapor, such that vaporizable material is removed from the solid material, the removed vaporizable material being fed to a steam generator wherein it is used to produce clean saturated steam by heating the condensate from indirect heating of the fluidized bed.

18 Claims, 4 Drawing Figures

VAPOUR
64
62
60
RAW COAL
56
58
DRY COAL TO BOILER
58
CONDENSATE
54
CONDENSATE
52
CONDENSATE
50
STEAM

FLUIDIZED BED DRYING

CROSS-REFERENCE IN RELATED APPLICATIONS

Co-filed Application No. 974,245, filed Dec. 29, 1978 based on Australian Application No. PD 3341 filed Feb. 10, 1978, and co-filed Application No. 974,244, filed Dec. 29, 1978 based on Australian Application No. PD 3342 filed Feb. 10, 1978, the disclosures of which are incorporated herein by reference.

The present invention relates to fluidized bed drying of solid material containing vapourisable material such as drying of solid material containing water or removal of solvent from solid material.

Combustion of coal for power generation is adversely affected by high moisture content in the coal. This is particularly so with brown coal which often contains two pounds water per pound of dry coal and therefore presents special problems in combustion. It is possible to increase the efficiency of a boiler substantially by burning dry coal instead of raw coal.

It is known to dry brown coal prior to combustion using hot combustion gases or air which has been heated by steam or hot gases and drawing or blowing the gas over or through the brown coal in particulate form. However, this method of drying offers no advantages compared to burning raw coal since the steam driven off is admixed with gas. The gas/steam mixture is simply vented to the atmosphere and its energy content lost since it is not economical to attempt to recover or use the energy. Also this method of drying is hazardous.

The present invention relates to a method and apparatus in which solid materials are dried and vapour resulting from the drying is used for further drying purposes. The drying system of the present invention is much less hazardous than known drying systems.

In our co-filed Patent Application No. 974,245 there is described in detail a method of drying a solid material containing a vapourisable material which comprises establishing a fluidized bed containing the solid material in which the fluidizing medium is the vapourisable material in vapour form and in which the fluidized bed is heated indirectly, such that vapourisable material is removed from the particulate material for further use.

The invention of the above mentioned co-filed Patent Application is described with particular reference to the drying of brown coal in an electrical power station environment where the brown coal provides the combustible material which is burned to produce heat which is used to convert water to steam and the steam used to drive turbines which generate electricity. However, that invention is of general applicability where it is necessary to remove a vapourisable material from a solid material. For example, the method of that invention may be used for removing solvent from particulate catalyst materials used in industrial processes. Since the fluidizing medium is the vapourisable material, in this case the solvent, the solvent is not contaminated with other fluidizing gases and can be readily recycled for further use.

In accordance with the present invention there is provided a method of drying a solid material containing a vapourisable material which comprises establishing a fluidized bed containing the solid material in which the fluidizing medium is the vapourisable material in vapour form and in which the fluidized bed is heated indirectly, such that vapourisable material is removed from the particulate material, wherein the removed vapourisable material is used to provide further indirect fluidized bed heating.

In particular, the present invention relates to multiple effect drying or mechanical vapour recompression.

The present invention provides in one embodiment multiple effect drying using a plurality of fluidized bed apparatuses comprising a housing; means for feeding particulate material containing vapourisable material to the housing to form the bed; means for removing particulate material having a reduced vapourisable material content from the housing, means for removing vapourisable material driven off from the particulate material from the housing, optional means for introducing carrier vapour to the fluidized bed and means for indirectly heating the fluidized bed.

An example of such an apparatus is described in detail in our co-filed Patent Application No. 974,245.

The present invention is applicable to drying of particulate material in which the particulate material forms the fluidized bed in the absence of any other solid particles. It is also applicable to the drying of lump material in which the fluidized bed contains another, particulate material which constitutes the fluidizing material and the lump material is fed into the fluidized bed. Drying of lump material is described in detail in the co-filed complete specification based on our Patent Application No. 974,245. The present invention will be described hereinafter with reference to drying of particulate material but it is to be understood that it is equally applicable to drying of lump material.

In accordance with one aspect of the present invention there is provided a multiple effect method of drying a particulate material containing a vapourisable material which comprises establishing at least first and second fluidized beds of the particulate material in which the fluidizing medium is the vapourisable material in vapour form and in which the fluidized bed is heated indirectly, such that vapourisable material is removed from the particulate material, the first fluidized bed being at a pressure higher than the second fluidized bed, wherein the vapourisable material removed from the particulate material in the first fluidized bed is used to provide the indirect heating of the second fluidized bed.

In accordance with the present invention there is also provided a fluidized bed multiple effect drying apparatus comprising at least first and second fluidized bed housings, means for feeding particulate material containing vapourisable material to each housing to form the bed, means for removing particulate material having a reduced vapourisable material content from each housing, means for removing vapourisable material driven off from the particulate material from the housing, and means for indirectly heating each fluidized bed, wherein means is provided to enable the vapourisable material driven off from the first fluidized bed to supply heat to the indirect heating means of the second fluidized bed.

In the present invention if there are two effects in series, one pound of steam can in practice, allowing for heat losses, evaporate at least 1.56 lb. water and if there are three effects the evaporation can be at least 1.85 lb. water. The solids can flow co-current, counter-current or cross-current with the steam.

The present invention will hereinafter be described with particular reference to drying of coal but it is equally applicable to drying of other particulate materials.

In a co-current system coal is fed to a means for introducing it to a fluidized bed, such as a lock hopper where it is pressurized to the pressure of a first high pressure fluidized bed. The coal in particulate form is introduced into the first fluidized bed wherein it is partially dried. The partially dried coal is then introduced to one or more lower pressure effect fluidized beds wherein the pressure decreases in succession. After exiting from the last fluidized bed in the series it is sufficiently dried for use and is fed to storage or boiler. The vapour generated in the first high pressure fluidized bed is typically cleaned by cyclones and fed to the dryer tubes of the next fluidized bed in the series. This process is repeated for each of the fluidized beds in the series.

Should coal particles accumulate on the heating surface, the condensate may be filtered and sprayed onto the heating surface intermittently or continuously. The coal and steam move in parallel paths in the same direction.

In a counter-current system coal is fed first to a low pressure effect fluidized bed where it is partially dried and then transferred to the next higher pressure fluidized bed in the series. Steam is first admitted into the dryer tubes of the high pressure effect. Vapour from the high pressure effect is passed to the next lower pressure effect and so on. Thus, steam and coal move in parallel paths in opposite directions.

Where dried coal is put to different applications e.g. combustion for power generation and manufacture of liquid fuels, a cross-current system may be employed. Such a system may be desirable if partially-dried materials do not fluidize well but materials fully, or almost fully, dried, do fluidize well. In this case the steam as before proceeds from high to low pressure effects. Coal is admitted continuously to each effect. Thus, dry coal is available from the high pressure effect at high temperature and from lower pressure effects at correspondingly lower temperatures.

Preferably, the pressure employed in multiple effect systems ranges between 2500 p.s.i.a. and 0.75 p.s.i.a.

With brown coal volatiles are released at about 270° C. and this sets a practical upper limit to the temperature of the coal in the high pressure effect. Allowing for some degree of superheat, which can only be maintained when the coal contains less than 40% moisture or, in general, when the material is sufficiently dry to exert less than the vapour pressure of water (or solvent) at the temperature of the solid, and a temperature difference of 110° C. then only two effect operation is possible e.g. high pressure effect at 240° C. and low pressure effect at 130° C. Alternatively, the lowest pressure effect must be under vacuum operating at for example, 20° C. If a lower temperature difference of say 100° C. were employed the high pressure effects might be at 240° C., intermediate pressure at 140° C. and low pressure at 40° C. (under vacuum).

Multiple effect drying gives similar effects to those which are obtainable by the methods discussed in the above mentioned co-filed Patent application in which the same steam is used for power generation and for drying.

An alternative method of achieving economical operation is to take the dirty vapour emitted by the dryer and pass it to the heating tubes of another, conventional dryer which is fluidized by another gas such as air or flue gas. If the former dryer is operating at atmospheric pressure then the dirty vapour leaving it will condense in the heating tubes of the latter dryer at 100° C., approximately. If the bed of the latter dryer is heated to 50° C. or 60° C. by the condensing vapour, such as steam, vapourisable material will vaporise into the air or flue gas, which will leave saturated with vapour at the bed temperature. In the general case, the air or flue-gas will pass through a cyclone or bag-filter system and possibly an electrostatic precipitation. In the special case where coal drying, e.g. brown coal drying, is undertaken prior to combustion and air is passed into the fluidized bed, then after passage through the cyclones, the air may be fed to the boiler. Precautions would be necessary to ensure that the coal-air mixture did not fall in the explosive region for such coal-air mixtures. In this case the water-vapour is a diluent which absorbs some of the heat of combustion of the coal, with deleterious effect on the efficiency. The second dryer is of conventional type and the other gas e.g. air or flue-gas entering may be at substantially higher temperature than the temperature obtaining in the bed.

This two-effect method of operation, with fluidization in one effect by another gas and in the other by water vapour may be used in the power station in place of the system whereby one steam-fluidized dryer is used and the water vapour used to generate clean steam for the low pressure turbines as is described in detail in our co-filed Application No. 974,246.

Thus, in the power-station, steam may be withdrawn from a high pressure or intermediate pressure turbine and passed to the steam-fluidized dryer as before. The dirty vapour produced may pass to a dryer fluidized with air and after passing through cyclones to remove most of the entrained coal, the moist air passes to the boiler to support combustion. Coal flows from the storage bin into the air-fluidized dryer in which about half the moisture is removed. Then the "half"-dry coal is transferred to the second bed which is fluidized by water-vapour and the drying process carried to the desired final moisture content.

Alternatively, coal is partially dried in the steam-fluidized dryer and then finally dried in the gas-fluidized dryer. Also, a further possibility is that the two dryers may be operated in cross-flow so that each is fed independently with coal and dried coal is removed from each dryer. Instead of coal any particulate material needing drying may be employed.

Thus, it is possible to have two effects operating at the same pressure which is not possible when pure vapour is used as the fluidizing medium which requires that each effect operate at different pressure as described above.

The dirty vapour produced from the dryer in accordance with the method of the present invention also lends itself to mechanical vapour recompression. The dirty vapour is preferably first passed through a cyclone system to remove solids which are preferably returned to the fluidized bed. The vapour from the cyclone is then passed to a steam-generator which produces clean steam by heating the condensate from the dryer tubes. The clean steam will be saturated but may be superheated before recompression to produce compressed saturated vapour in an appropriate apparatus such as a centrifugal compressor to a sufficiently high pressure for an adequate heat transfer rate in the drier such as between 20 and 2000 p.s.i.a., preferably between 50 and 500 p.s.i.a. The compressed steam after de-superheating e.g. by condensate spraying, may be passed through the dryer tubes of the same fluidized bed to effect further drying of raw coal.

The use of mechanical vapour recompression in which the condensate from the dryer tubes is reheated and compressed and used again can give in practice the same performance as a two or three effect multiple dryer as discussed herein.

Further, carrier steam as discussed above may be drawn from the compressor at a low pressure such as less than 10 p.s.i.a. e.g. 5 p.s.i.a., above the fluidized bed pressure which will be preferably close to atmospheric, and fed to a distributor at the bottom of the dryer. Alternatively, a separate fan may be employed to return product vapour to the bed as carrier steam.

The present invention will now be described by way of Example with reference to the accompanying drawings, in which.

Figure 1:
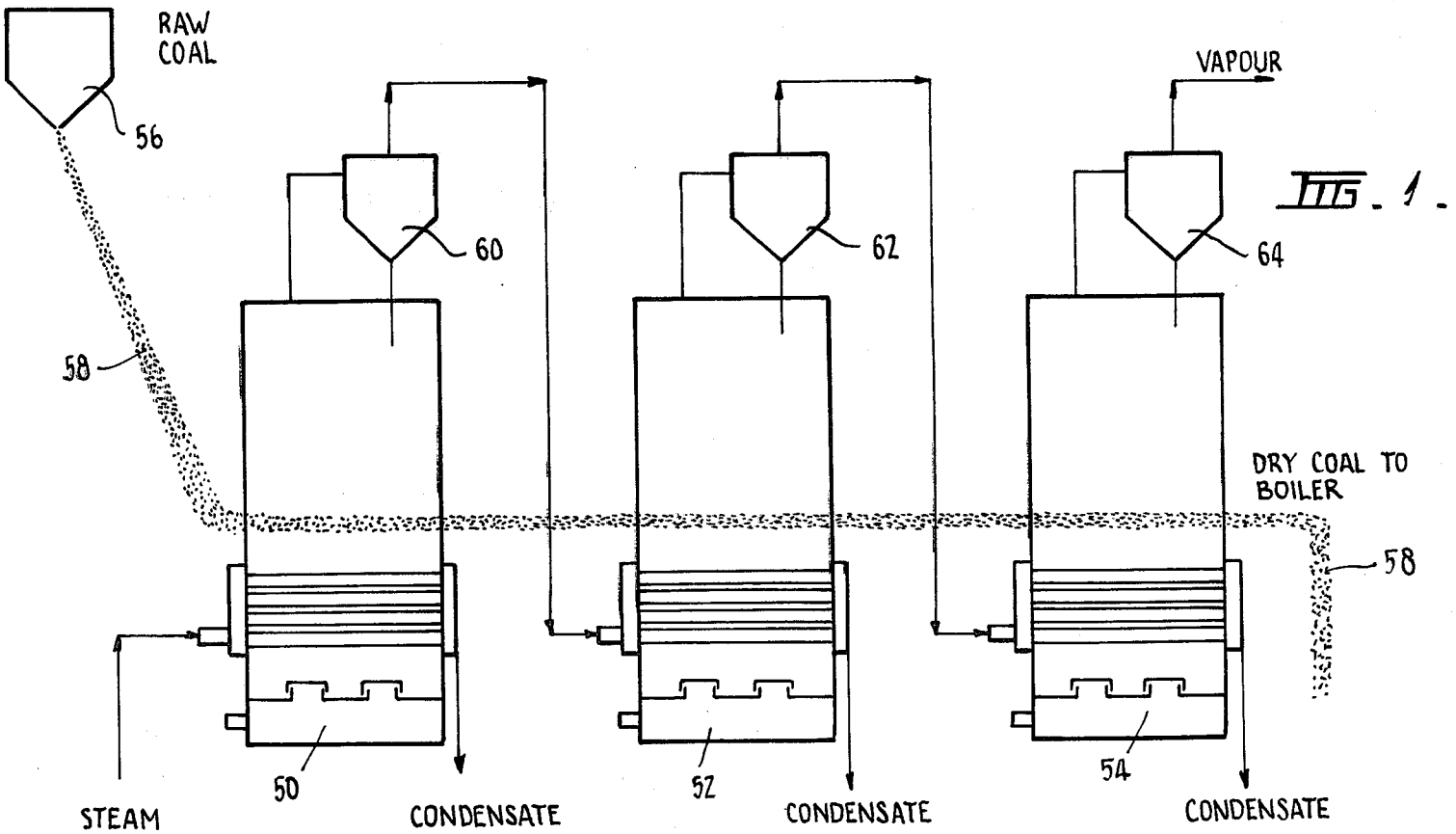
FIG. 1 is a schematic flow diagram illustrating a co-current multiple effect process in accordance with the present invention.

In FIG. 1 there is shown a co-current triple-effect dryer in accordance with the present invention. The apparatus comprises three driers 50, 52 and 54 in series. Coal is fed from a hopper or other storage means 56 along the schematic dotted line 58 through each dryer in turn starting with the dryer 50. Steam is fed into the heating tubes of the dryer 50 under high pressure and at a high temperature. The steam transfers heat to the coal in dryer 50 and so causes moisture to be driven off from the coal in the form of dirty steam. The steam from the dryer tubes is converted into a condensate which is subsequently processed for further use. The dirty steam is passed to a cyclone 60 and then to the dryer tubes of the dryer 52. Alternatively steam from the cyclone 60 may pass to a clean steam generator the steam from which passes to the dryer tubes of the dryer 52. The dryer 52 is operated at an intermediate pressure and temperature. As with dryer 50 the steam from the dryer tubes is converted to condensate and dirty steam is driven off from the coal.

The dirty steam from dryer 52 passes to a cyclone 62 and then to the dryer tubes of the dryer 54 or through a clean steam generator the steam from which passes to the dryer tubes of the dryer 54. The dryer 54 is operated at a low pressure and temperature. Further, dirty steam is driven off from the coal in dryer 54 and this dirty steam passes to a cyclone 64 and is used for process heating or steam generation or is passed to a condenser. The dried coal emerges from dryer 54 in a relatively cool condition.

Figure 2:
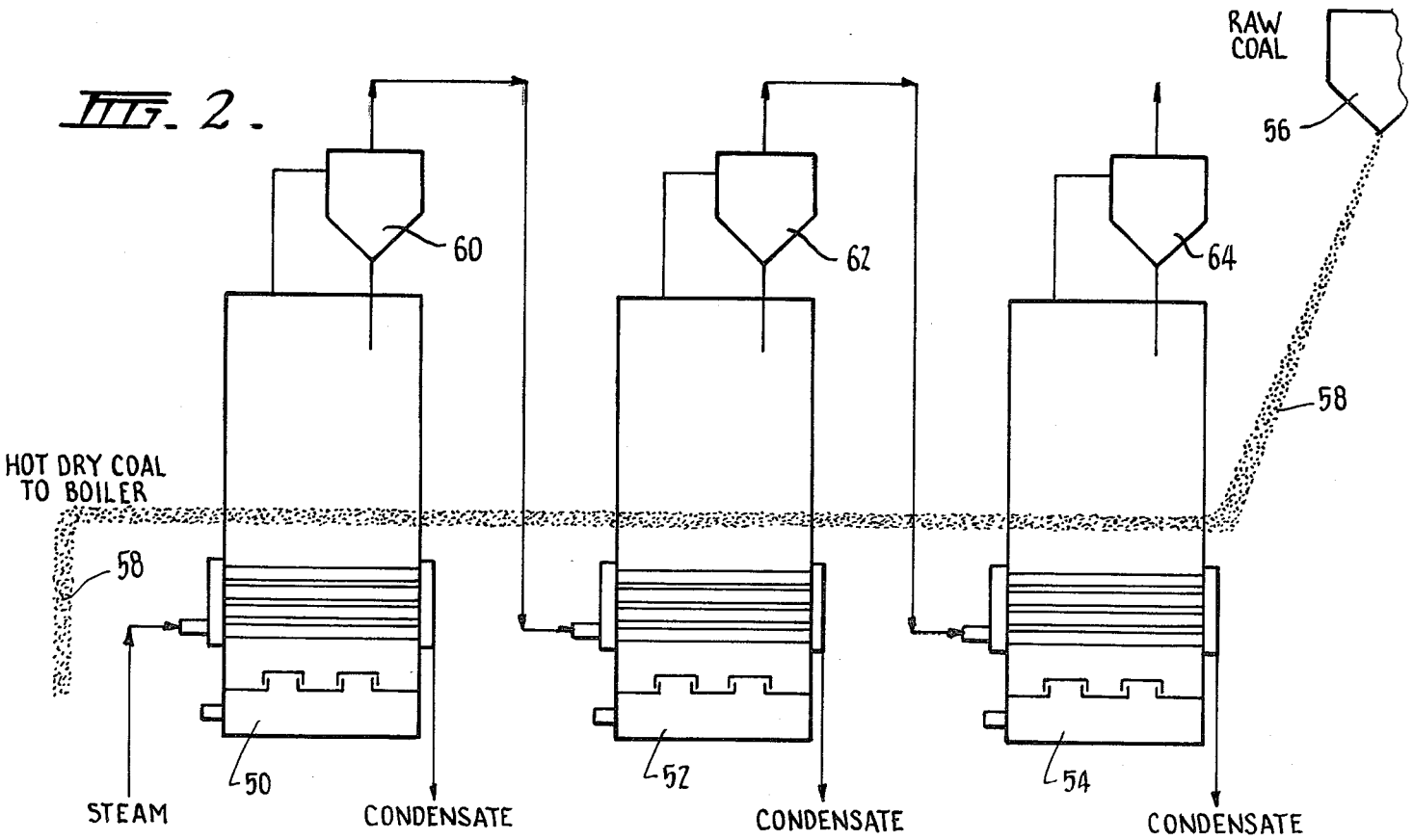
FIG. 2 is a schematic flow diagram illustrating a counter-current multiple effect process in accordance with the present invention.

In FIG. 2 there is shown a counter-current triple effect dryer in accordance with the present invention. The apparatus of FIG. 2 operates in much the same manner as that of FIG. 1 except that the coal is first fed to low pressure and temperature dryer 54, then to the intermediate dryer 52 and finally to the high pressure and temperature dryer 50. In this case the coal emerges in a relatively hot condition.

Figure 3:
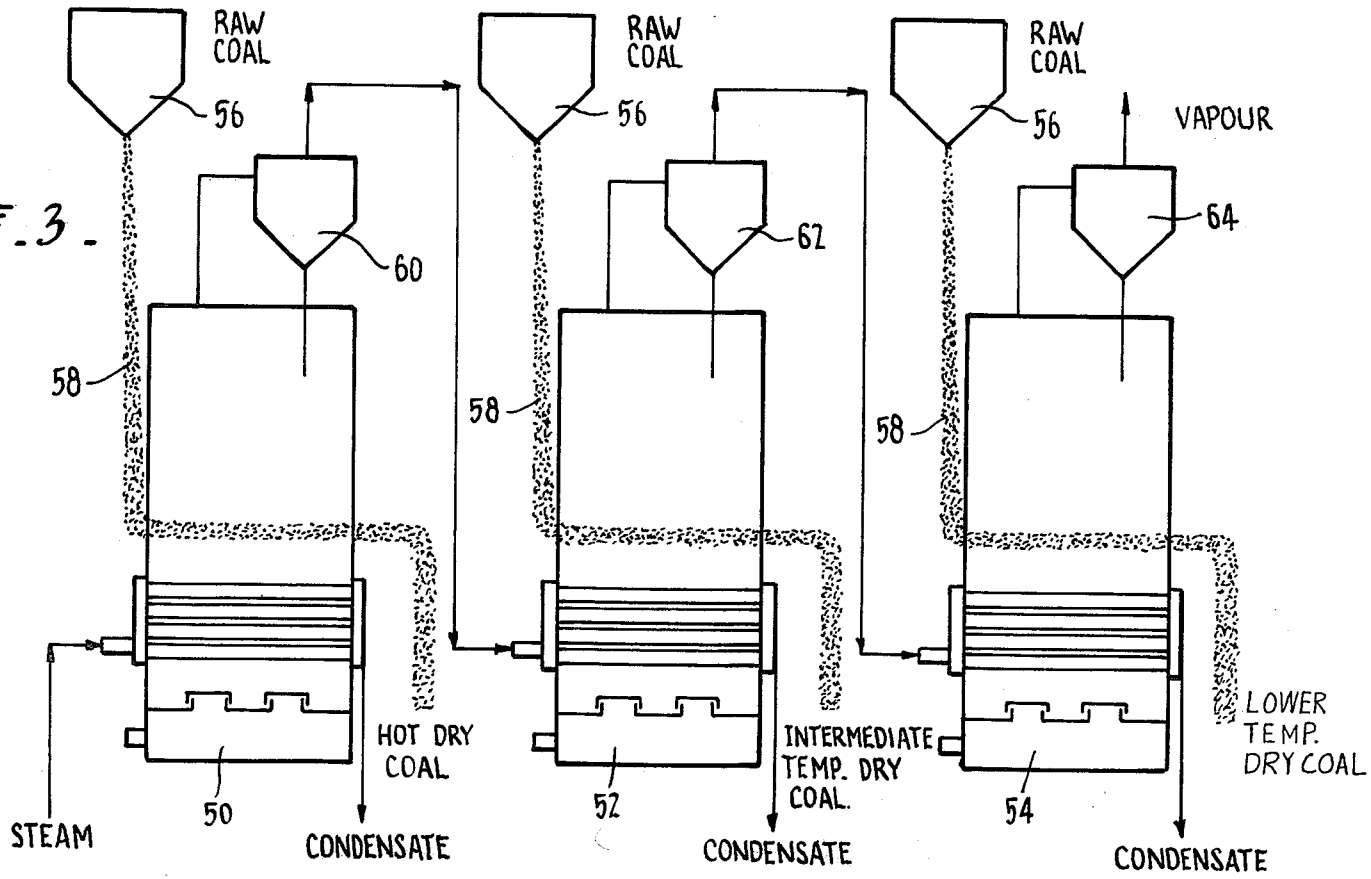
FIG. 3 is a schematic flow diagram illustrating a cross-current multiple effect process in accordance with the present invention.

In FIG. 3 there is shown a cross-current triple effect dryer in accordance with the present invention. This operates in a similar manner to the dryer of FIGS. 1 and 2 except that as coal is independently fed to each dryer and removed dry the coal from each of the three dryers is at a different temperature. Hot dry coal is obtained from dryer 50, intermediate dry coal is obtained from dryer 52 and cool dry coal is obtained from dryer 54.

Figure 4:
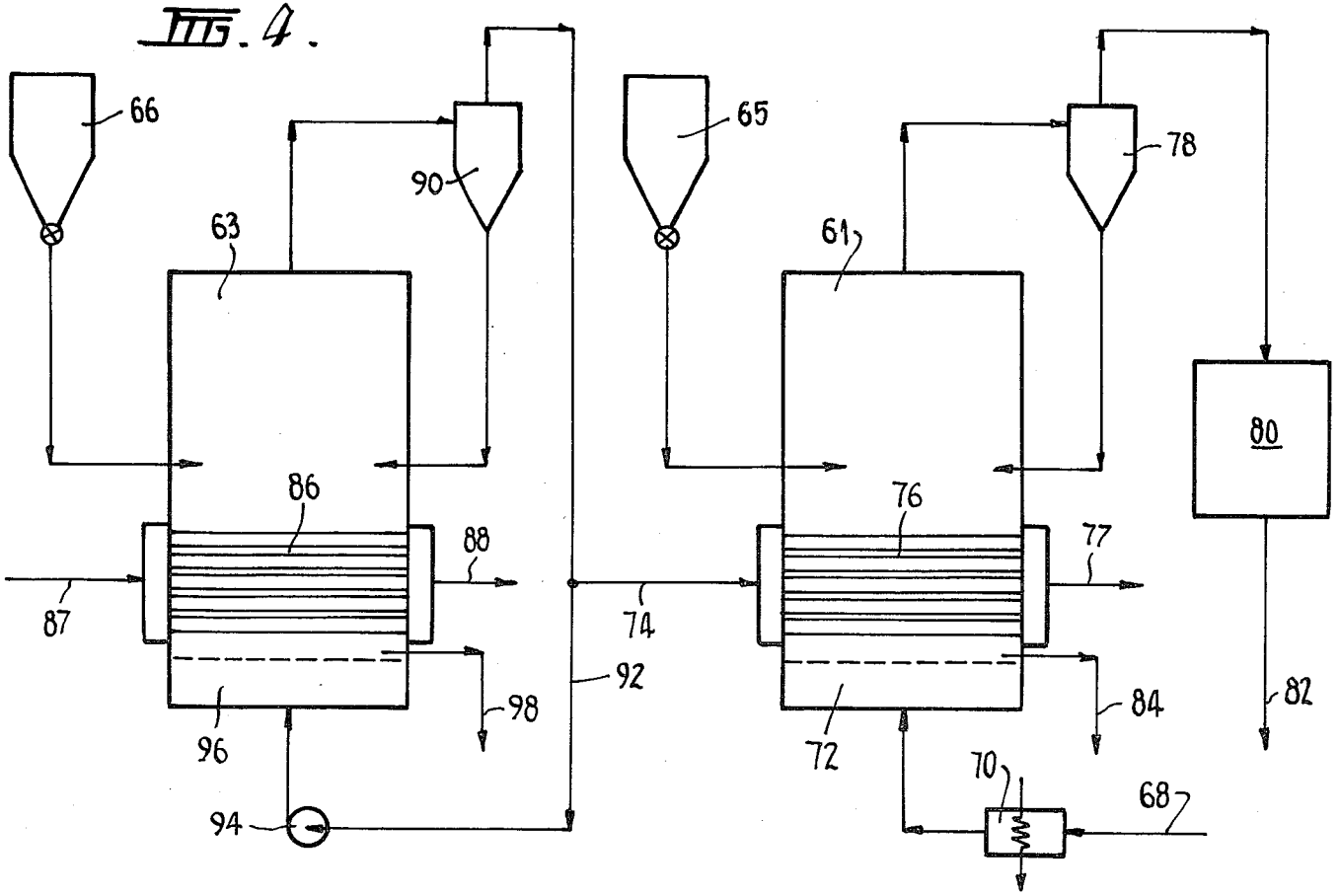
FIG. 4 is a schematic flow diagram illustrating a cross-current drying process in accordance with the present invention.

In FIG. 4 of the accompanying drawings, there is shown, by way of example, a schematic flow diagram illustrating a cross-current drying process for coal in which one fluidized bed is fluidized by steam and the other fluidized bed is fluidized by hot gas. The process illustrated in FIG. 4 can also be adapted for co-current and counter-current systems.

In FIG. 4 there is shown a first fluidized bed dryer 61 and a second fluidized bed dryer 63. Particulate coal is fed from a bin 65 to the dryer 61 and from a bin 66 to the dryer 63. Gas is fed along a line 68 through a preheater 70 in which it is heated to an appropriate temperature as is known in the art, into a plenum 72 at the base of the dryer 61 and then into the fluidized bed of the dryer 61.

Steam obtained as dirty vapour from the dryer 63 is fed along a line 74 into drying tubes 76 of the dryer 61. The steam in the drying tubes 76 indirectly heats the material in the fluidized bed to a temperature of about 50° or 60° C. and itself condenses to leave the drying tubes 76 at a temperature of about 100° C. The dirty condensate may typically be fed to a filter (not shown) through a line 77 to remove particulate material and then used as described above.

The heating of the fluidized bed in the dryer 61 causes steam to vapourise into the hot gas which leaves the dryer 61 as saturated with steam at the bed temperature. The saturated gas is then passed to a cyclone 78 from which removed solids are returned to the fluidized bed of the dryer 61 and the gas is passed through a filter such as bag-filter or electrostatic precipitator 80. The gas from the filter, if air, may proceed to a boiler furnace through a line 82.

Dry coal is withdrawn from the dryer 61 through a line 84.

In the dryer 63, saturated steam, for example from a boiler or turbine, is fed into drying tubes 86 through a line 87. The steam in the drying tubes 86 indirectly heats the material in the fluidized bed to a temperature of about 110° C. and itself condenses. The condensate from the drying tubes 86 is fed through a line 88 to a boiler. The fluidizing medium in the dryer 63 is steam which is given off from the fluidized bed as dirty steam relatively uncontaminated by air or other gases. The dirty steam is passed to a cyclone 90 wherein particulate matter is removed and returned to the dryer 63. The steam from the cyclone 90 is fed partially along the line 74 to the dryer 61 as described above and partially along a line 92 through a pump means 94 into a plenum 96 at the base of the dryer 63.

The steam fed into the plenum 96 passes into the fluidized bed and serves as carrier vapour as described hereinabove.

Dry coal is removed from the dryer 63 through a line 98.

In the system shown in FIG. 4 both systems operate at substantially the same pressure.

The multiple effect drying system of the present invention has particular application to the hydrogenation of coal in which it is important to have an economical drying method.

Modifications and variations such as would be apparent to a skilled addressee in the art of drying particulate material are deemed within the scope of the present invention. For example, the multiple effect drying and mechanical vapour recompression systems and the two-stage system with one dryer fed with non-condensible gas of the present invention may be used in connection with an electrical power generation system as described in detail in our co-filed Patent Application No. 974,246 entitled "Power Generation System".

We claim:

1. A fluidized bed multiple effect drying apparatus, comprising at least first and second fluidized bed housings, means for feeding solid material containing vapourisable material to each housing to form the bed, means for removing solid material having a reduced vapourisable material content from each housing, means for removing vapourisable material driven off from the solid material from the housing, and means for indirectly heating each fluidized bed, wherein means is provided to enable the vapourisable material driven off from the first fluidized bed to supply heat to the indirect heating means of the second fluidized bed.

2. A method of drying a solid material containing a vapourisable material which comprises establishing a fluidized bed containing the solid material, utilizing, as the fluidizing medium, the vapourisable material in vapour form, heating the fluidized bed indirectly by vapourisable material in the form of a saturated vapour such that vapourisable material is vaporized from the solid material, and such that a condensate of said saturated vapour is produced, feeding said condensate to a steam generator, and feeding the removed vapourisable material to said steam generator to produce clean saturated steam by heating said condensate from indirect heating of the fluidized bed.

3. A method as claimed in claim 2, further comprising compressing the clean saturated steam to form a superheated steam and then de-superheating said superheated steam to render it saturated.

4. A method as claimed in claim 3, which comprises, prior to compression, heating the clean steam to reduce the liquid water content thereof.

5. A multiple effect method of drying a solid material containing a vapourizable material which comprises;

providing at least first and second fluidized bed housings for establishing at least first and second fluidized beds therein, each of said housings comprising means for indirectly heating a fluidized bed therein;

feeding solid material containing varpourizable material to each housing to form a fluidized bed therein;

providing a fluidizing medium in each housing to form said fluidized bed therein, said fluidizing medium in at least the first fluidized bed being the said vapourizable material in vapour form;

removing solid material from each housing;

removing vapour of said vapourizable material from each housing;

indirectly heating each fluidized bed to vapourize said vapourizable material;

maintaining the partial pressure of the vapour of said first fluidized bed higher than that of said second fluidized bed; and utilizing said vapour removed from said first housing to indirectly heat said second fluidized bed.

6. A method as claimed in claim 5 in which in each of said fluidized beds the fluidizing means comprises said vapourizable material in vapour form.

7. A method according to claim 5 wherein the first fluidized bed is maintained at a pressure higher than that of the second fluidized bed.

8. A method as claimed in claim 7 wherein the step of feeding said solid material to each housing comprises feeding solid material containing vapourizable material to said first housing to form said first fluidized bed therein wherein the solid material is partially dried, removing partially dried solid material from said first housing, and feeding said removed solid material to said second housing to form said second fluidized bed therein.

9. A method as claimed in claim 7 wherein the step of feeding said solid material to each housing comprises feeding solid material containing vapourizable material to said second housing to form said second fluidized bed therein wherein the solid material is partially dried, removing partially dried solid material from said second housing, and feeding said removed solid material to said first housing to form said first fluidized bed therein.

10. A method as claims in claim 7 wherein the step of feeding said solid material to each housing comprises feeding a separate feed stream of solid material to each housing whereby the solid material removed from each housing is obtained in a condition dependent upon the fluidized bed in which it is dried.

11. A method as claimed in claim 5 wherein the fluidizing medium in said second housing comprises a gas supplied from an external source whereby vapour removed from said second fluidized bed is in the form of the externally supplied gas saturated with the vapourizable material.

12. A method as claimed in claim 5 wherein a series of more than two fluidized beds is established including a last fluidized bed in which the partial pressure of the vapour is lowest, wherein the fluidizing medium in each fluidized bed except the last of the series is the vapourizable material in vapour form, and the fluidizing medium in the last fluidized bed comprises a gas supplied from an external source, wherein vapour generated in each fluidized bed of higher partial pressure is used to provide indirect heating of the fluidized bed of next lower partial pressure, and wherein the vapour removed from the last fluidized bed is in the form of the externally supplied gas saturated with the vapourizable material.

13. A method according to claim 5 wherein the step of utilizing said vapour to indirectly heat said second fluidized bed comprises feeding said vapour directly, as saturated vapour, to the indirect heating means of said second housing whereby said saturated vapour condenses.

14. A method as claimed in claim 5 in which the vapour removed from said first fluidized bed is fed to a steam generator from which is obtained clean saturated steam which is fed directly to said second fluidized bed to indirectly transfer heat to the further fluidized bed and become condensed.

15. A method as claimed in claim 5, in which the vapourizable material is water.

16. A method as claimed in claim 15, in which the solid material is brown coal.

17. A method as claimed in claim 5 in which the solid material is particulate and forms the fluidized beds in the absence of any other solid material.

18. A method as claimed in claim 5, in which the solid material is in lump form and the fluidized beds contain another, particulate, material which constitutes the fluidizing material.

* * * * *